United States Patent [19]

Nau et al.

[11] 4,068,636

[45] Jan. 17, 1978

[54] THERMOSTATIC DEVICE FOR AUTOMATIC CHOKE CONTROL

[75] Inventors: Paul R. Nau, Wauwatosa; James L. Bartlett, Mequon; Heinz K. Gund, Brookfield, all of Wis.

[73] Assignee: Briggs & Stratton Corporation, Wawwatosa, Wis.

[21] Appl. No.: 626,928

[22] Filed: Oct. 29, 1975

[51] Int. Cl.[2] ..... F02M 1/10

[52] U.S. Cl. ..... 123/119 B; 123/119 F; 261/39 B

[58] Field of Search ..... 123/119 B, 119 F; 261/39 B

[56] References Cited

U.S. PATENT DOCUMENTS

| | | | |
|---|---|---|---|
| 2,245,093 | 6/1941 | Meston | 123/119 F |
| 2,381,751 | 8/1945 | Hunt | 123/119 F |
| 2,693,791 | 11/1954 | Lechtenberg | 123/195 R |
| 3,118,433 | 1/1964 | Lechtenberg | 123/41.31 |
| 3,529,585 | 9/1970 | Stoltman | 123/119 F |
| 3,625,492 | 12/1971 | Reichenbach | 261/64 C |
| 3,877,223 | 4/1975 | Layton | 123/119 F |

*Primary Examiner*—Charles J. Myhre
*Assistant Examiner*—David D. Reynolds
*Attorney, Agent, or Firm*—Ira Milton Jones & Associates

[57] ABSTRACT

End portions of the choke valve shaft project outside the carburetor mixing passage duct. One end portion is connected with an actuator mechanism that is responsive to either engine speed or manifold pressure. The other projects into a cylindrical chamber on the carburetor body that houses a spirally coiled bimetal strip having its inner end connected with the shaft, its outer end engageable with circumferentially spaced abutments. The chamber is communicated with the crankcase breather and also with the mixing duct through a flapper valve, so that the bimetal is subjected to the temperature of vented crankcase vapors.

10 Claims, 9 Drawing Figures

THERMOSTATIC DEVICE FOR AUTOMATIC CHOKE CONTROL

This invention relates generally to automatic choke control mechanisms for the carburetors of internal combustion engines, and is more specifically concerned with a temperature responsive automatic choke control device for single-cylinder engines.

The small single-cylinder engines that are widely used for powering such machines as lawn mowers, garden tractors, snow blowers, portable sump pumps and portable electrical generators are now being increasingly equipped with automatic apparatus for choke control because it is recognized that the operators of such engines cannot be expected to possess the knowledge and dexterity that would enable them to manipulate a manually actuated choke with such skill as to achieve the fastest and easiest starting of the engine under all conditions.

Perhaps the most successful automatic choke control mechanism for small engines that has heretofore been made available to the public is that of the Reichenbach et al U.S. Pat. No. 3,625,492, wherein the actuator for the choke valve comprises a diaphragm which defines one wall of a suction chamber and which is connected by means of a link to an eccentric on the choke valve shaft. The suction chamber that is in part defined by the diaphragm is communicated through a restriction with the engine intake manifold, so that when the engine is running, the diaphragm tends to be drawn into the suction chamber by a subatmospheric pressure therein and thus tends to open the choke valve. However, the suction force exerted upon the diaphragm is opposed by a spring that tends to close the choke valve. Since suction increases with increasing engine speed and is opposed by spring force, the choke valve is fully closed when the engine is stopped and is automatically opened as necessary to provide the optimum fuel-air mixture ratio for any speed at which the engine may be running. Because the mechanism is primarily responsive to manifold pressure — which is a function of both engine speed and throttle setting — it not only achieves quick and easy engine starting but has the further important advantage of responding to rapid opening of the throttle in a manner similar to an acceleration pump, thus affording a degree of automatic mixture control that ensures good performance throughout the speed range of the engine.

The choke control apparatus of the Reichenbach et al patent has all of the virtues that are essential in single-cylinder engine equipment. It is low in cost, very compact, extremely simple mechanically, durable even under abuse, and almost one hundred percent reliable. It has therefore enjoyed great commercial success, and widespread experience with it has revealed no disadvantages.

However, the engines on which that automatic choke control mechanism have heretofore been installed have been equipped with a single control in the form of a lever that was movable between a "Stop" position and a "Fast" position, through a "Slow" position. Through most of its range of travel this lever effected adjustment of the throttle, but in its "Stop" position it closed a switch that grounded the ignition magneto so that the spark plug could not fire. With this arrangement, the throttle was closed whenever the engine was deliberately stopped, because the control lever passed through the "Slow" position in being moved to the "Stop" position. In consequence, no substantial amount of fuel was drawn into the carburetor mixing passage when the engine was shut down, and if the engine was restarted while still hot, the closed choke valve enabled the correct amount of fuel for starting to be drawn into the mixing passage. The automatic choke control mechanism thus enabled a hot engine to be restarted as easily as a cold one, even though the apparatus included no thermostatic element and was in no way responsive to engine temperature as such.

However, a recent trend of developments in the lawn mower industry poses a new problem in automatic choke control that cannot be completely and satisfactorily solved without modifying the apparatus of the Reichenbach et al patent to compensate for engine temperature.

It has been recognized that it may be desirable, from a safety standpoint, to equip rotary power lawn mowers with a so-called dead man control that causes the engine to stop as soon as the operator lets go of the control handle. The easiest, fastest and surest way to stop an engine is to shut off its ignition, and the contemplated dead man control will thus take the form of a normally closed magneto grounding switch wired in parallel with the switch at the throttle control lever. However, when stopping of the engine is effected by means of such a dead man ignition control, the throttle can be expected to remain open, and therefore a substantial charge of fuel will be drawn into the carburetor mixing passage as the engine decelerates through unfired strokes and the choke valve closes in response to decreasing suction in the intake manifold. In effect, the choke control would behave as if the engine had been decelerated by an increased load and would operate to enrich the mixture. If the engine were then to be restarted while still hot, the choke valve would again be closed through the first few starting strokes, and the engine would be flooded.

The use of a dead man control connected in the engine ignition circuit thus requires that an automatic choke control apparatus embodying the principles of the Reichenbach et al patent be responsive to engine temperature as well as to manifold pressure. Obviously, however, any temperature responsive element incorporated into such apparatus should be so arranged that it will not interfere with operation of the instrumentalities responsive to manifold pressure at times when those instrumentalities, by themselves, are capable of effecting proper automatic choke actuation.

Thus one of the general objects of the present invention is to provide an automatic choke control apparatus which is primarily responsive to manifold pressure, like the Reichenbach et al mechanism, but which incorporates engine temperature responsive means to correct the operation of the manifold pressure responsive to mechanism under conditions that tend to occur when the engine is stopped by merely shutting off its ignition and is restarted while it is still hot.

Heretofore, thermostatic devices were incorporated in automatic choke control systems that were responsive to engine speed, for modifying the speed responsive actuation of the choke in accordance with engine temperature. It will be evident that a thermostatic choke control device which can be incorporated into the manifold pressure responsive choke control mechanism of the Reichenbach et al patent is also readily adaptable for incorporation into a choke control mechanism that is primarily speed responsive.

Hence it is another general object of the present invention to provide a temperature responsive device for automatic choke control systems generally, and which device is particularly suitable for automatic choke control mechanisms intended for small gasoline engines in that it has the extreme simplicity, ruggedness, compactness and low cost that are essential in equipment for such engines.

Where a thermostatic element is incorporated in an automatic choke control apparatus, the thermostatic element must be subjected to the heat of the engine itself, but the carburetor body in which the choke valve is located is normally spaced at least a small distance from the body of the engine. In prior small engine automatic choke control mechanisms comprising thermostatic elements, the thermostatic element was located in a well in the engine body casting, and there was usually a linkage connection between the thermostatic element and the choke valve. The linkage connection could be so arranged as to be easily adjustable to the particular thermostatic element with which it was associated, but is offered several possibilities for failure or malfunction, inasmuch as it comprised at least two joints that could stick or bind and at least one elongated link member that was susceptible to bending. See for example Armstrong U.S. Pat. No. 2,548,334 and Thompson et al U.S. Pat. No. 3,863,614.

By contrast, it is another object of the present invention to provide an automatic choke valve control device which comprises a thermostatic element and which is especially well suited for small engines, and wherein the thermostatic element is located in a chamber in the carburetor body but is nevertheless subjected to temperatures that are representative of those prevailing in the engine body.

It is also a specific object of this invention to provide an automatic choke control device comprising a thermostatic element that is directly connected with the choke valve shaft, and wherein there is very simple but effective provision for establishing the choke valve in a predetermined position when the thermostatic element is at a predetermined temperature, even though the thermostatic element is an inexpensive one, not made to close tolerance limits.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which.

Figure 1:
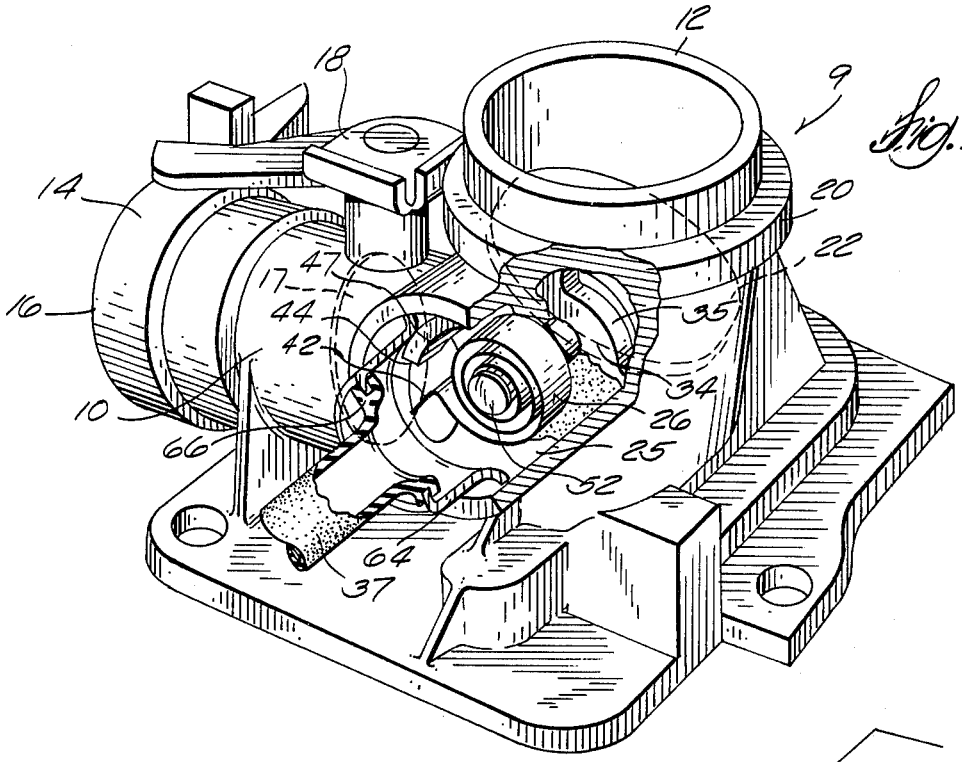
FIG. 1 is a perspective view of a carburetor embodying the principles of this invention, with portions shown broken away so that the thermostatic choke control device can be seen.
Figure 9:
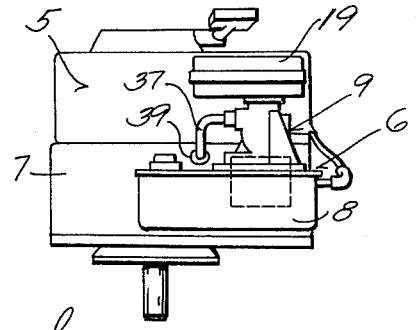
Figure 7:
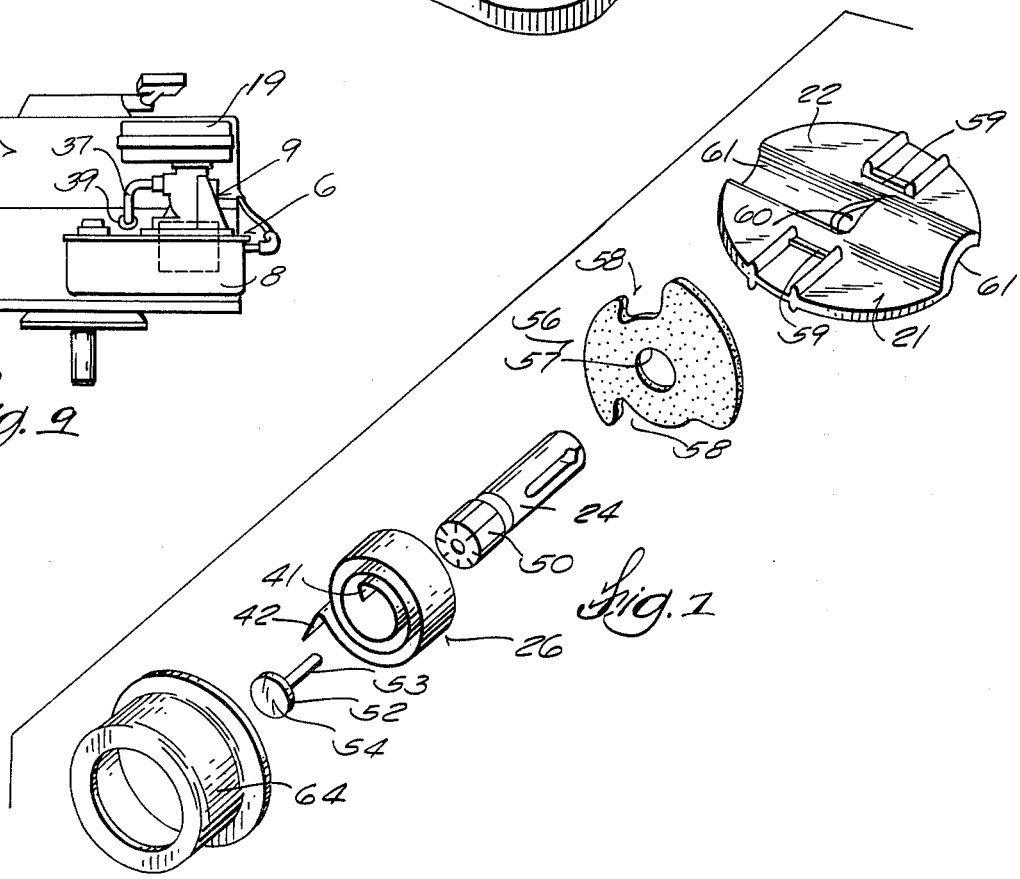
Figure 8:
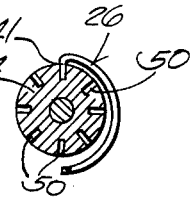
Figure 5:
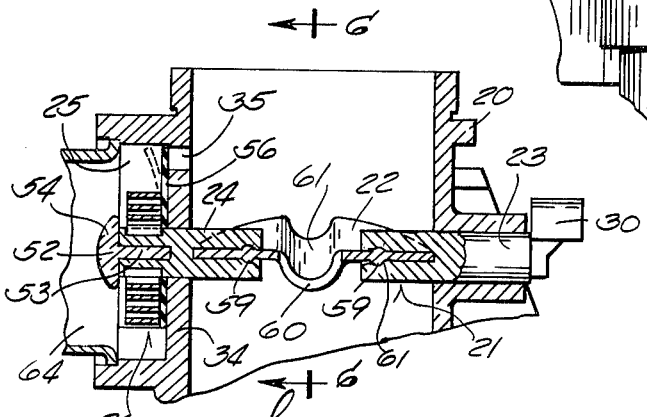
FIG. 5 is a sectional view taken on the plane of the line 5—5 in FIG. 3.

FIG. 7, on sheet 1, is a disassembled perspective view of the components of the thermostatic choke control device;

FIG. 8, on sheet 2, is a detail end view of the choke shaft, showing the connection of the bimetal thermostatic element thereto; and FIG. 9, on sheet 1, is a more or less diagrammatic view in side elevation and at a reduced scale of an engine having a carburetor embodying the principles of this invention.

Referring now to the accompanying drawings, the numeral 5 designates generally the body of a small gasoline engine, comprising a single cylinder 6 and a crankcase 7. Mounted alongside the engine body and supported from it is a tank 8 that holds a supply of fuel for the engine. Mounted on the top wall of the tank is a carburetor 9 by which fuel from the tank is vaporized and mixed with air for combustion in the cylinder.

The carburetor 9 is illustrated as being generally of the type disclosed in the above mentioned Reichenbach et al patent. It is also shown as having no float bowl but instead comprising part of a fuel system such as is fully disclosed in Lechtenberg U.S. Pat. No. 3,118,433, to which reference may be made for details not here illustrated. The carburetor 9 draws fuel from a reservoir (not shown) that is just beneath it, in the upper portion of the tank. Fuel is lifted into the reservoir from the tank proper by a diaphragm fuel pump (not shown) that is actuated by engine suction. To maintain a constant level in the reservoir, it is charged at a rate faster than the engine uses the fuel, and the excess spills back down into the tank through an overflow outlet.

The body of the carburetor 9, which may be formed as a die casting, comprising an L-shaped duct or tubular portion 10, sometimes referred to as an air horn and which defines an induction or mixing passage. This tubular carburetor body portion has a vertical, upwardly opening inlet leg 12 and a horizontal leg 14. The horizontal leg terminates at its outer or outlet end in a fitting 16 that is securable to an engine intake manifold. Between the fitting 16 and the vertical leg 12 the interior of the horizontal leg 14 is formed as a venturi in which there is a throttle valve 17. The position of the throttle valve is adjustable by means of a lever 18 that is accessible at the top of the carburetor body. Although not shown, it will be understood that a fuel jet opens into the mixing passage near the throttle valve and is communicated with the fuel reservoir in the top of the tank.

The portion of the carburetor body that defines the vertical leg 12 of the mixing passage is adapted to have an air cleaner 19 sealing fitted to its upper or inlet end which is provided with a circumferential lip or flange 20 on which the air cleaner is seated. All air entering the mixing passage will have been filtered by flow through the air cleaner.

A movable choke valve or butterfly 21 is located in the vertical inlet portion of the mixing passage, upstream from the throttle. When the choke valve is closed, it restricts flow of air into the venturi portion of the mixing passage, and suction in the venturi therefore tends to be relatively high, with the result that the engine receives a rich fuel-air mixture, suitable for starting. When the choke valve is fully open, it affords substantially no restriction to flow of air through the mixing passage and the engine receives a relatively lean mixture suitable for normal high speed operation. At intermediate positions the choke valve partially restricts the mixing passage and causes enrichment of the mixture to the extent necessary to enable the engine to produce relatively high torque when running at lower speeds.

The choke valve comprises a disc 22 from which coaxial shaft sections 23 and 24 project. These shaft sections, which together can be considered the shaft of the choke valve are journaled in the tubular wall of the mixing passage and project through that wall at diametrically opposite sides thereof. The shaft section 24 projects into a coaxial cylindrical well or chamber 25 which is formed as a part of the carburetor body and which houses a thermostatic element 26 that tends to position the choke valve in accordance with engine temperature. The other shaft section 23 can be connected with a mechanism that is responsive either to manifold pressure or to engine speed.

In the embodiment of the invention illustrated, the shaft section 23 is connected with a manifold pressure responsive mechanism like that of the Reichenbach et al patent, comprising a diaphragm 28 which defines one wall of a suction chamber 29 beneath the carburetor body. An eccentric or crank arm 30 on the outer end of the shaft section is connected with the diaphragm 28 by means of a link 31. An expansion spring 32 in the suction chamber 29 bears against the diaphragm at its underside to bias the choke valve towards its closed position. As more fully explained in the Reichenbach et al patent, the suction chamber 29 has restricted communication with the mixing passage in the carburetor body at a location downstream from the throttle valve 17, to maintain suction in the chamber 29 at a value that reflects the prevailing position of the throttle and speed of the engine. Under the influence of such suction the diaphragm 28 tends to swing the choke valve open as manifold pressure decreases. The parameters that control the opposing forces exerted by the spring and by the diaphragm are so chosen — as explained in the Reichenbach et al patent — that the choke valve is automatically positioned to enrich the mixture whenever the throttle setting corresponds to a higher speed than the engine is actually making.

As the description proceeds, it will become evident that the thermostatic control device of this invention is capable of cooperating with an engine speed responsive choke control mechanism that would be connected with the section 23 of the choke valve shaft. For example, such a speed responsive mechanism could be of the general type disclosed in Armstrong U.S. Pat. No. 2,548,334 or the Thompson et al U.S. Pat. No. 3,863,614, wherein there is either a link connection or a direct connection between the choke valve shaft and a swingable vane that is mounted adjacent to the conventional cooling air blower on the engine flywheel, the vane being positioned by the force of the cooling air stream acting in opposition to a biasing force.

The cylindrical well or chamber 25 that houses the thermostatic choke control element 26 projects laterally from the vertical or inlet leg 12 of the mixing passage duct. For the most part, that thermostat chamber is separated from the mixing passage by a wall portion 34 of the carburetor body through which the end portion 24 of the choke shaft extends, but there is an aperture 35 in that wall, described hereinafter, through which the chamber 25 is communicated with the mixing passage. The thermostat chamber is also communicated by means of a flexible duct 37 with the outlet of a conventional crankcase breather 39. As explained in Lechtenberg U.S. Pat. No. 2,693,791, to which reference may be made for details of the breather, the breather permits vapors to be vented from the crankcase 7 whenever pressure therein rises to above-atmospheric values but permits only very restricted flow of air into the crankcase, to maintain a slight vacuum in it that assures against leakage of oil through the bearings.

The vapors vented from the crankcase are at a temperature which reflects the operating temperature of the engine, and in being discharged into the mixing passage through the thermostat chamber 25 and the aperture 35, such vapors are caused to flow across the thermostatic element 26, subjecting it to a temperature which is at all times in direct relationship to that of the engine body even though the thermostatic element is located at some distance from the engine body. Communication of the crankcase breather with the inlet portion of the carburetor mixing passage is more or less conventional on present-day small engines, to ensure that such air as enters the crankcase through the breather will have been filtered; and the present invention thus utilizes this arrangement to full advantage inasmuch as the thermostat chamber 25 can be regarded as a part of the duct means that communicates the breather with the mixing passage.

Considering the temperature responsive choke control device in more detail, the thermostatic element 26 comprises a spirally coiled bimetal strip that reacts between the choke valve shaft and the carburetor body. The inner end portion of the strip is bent to project radially inwardly from its innermost convolution, forming a tab 41 that serves for connecting the strip with the section 24 of the choke valve shaft as explained below. The outer end portion of the strip is bent to project radially outwardly from its outermost convolution, forming a tab 42 that can engage either of a pair of opposing circumferentially spaced abutments 44 and 45 in the interior of the chamber 25.

The abutment 44 comprises one end of a short arcuate land 47 on the inner cylindrical wall surface of the chamber 25. The abutment 45 comprises the adjacent end of a similar but longer land 48 that is located more or less diametrically opposite the short land 47. Both lands are spaced inwardly of the front edge of the cylindrical wall of the chamber but extend all the way back to the bottom of the chamber 25 formed by the wall 34.

Figure 6:
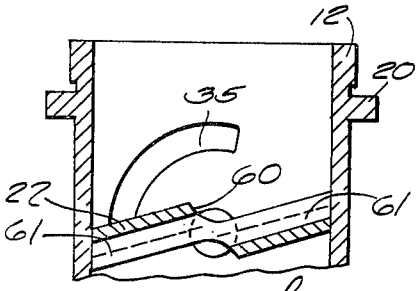
FIG. 6 is a sectional view through FIG. 5 on the plane of the line 6—6.

The aperture 35 in the wall 34, through which the chamber 25 is communicated with the mixing passage, as shown in FIG. 6, is an arcuate slot which extends from one to the other of those ends of the lands 47 and 48 that are remote from their abutments 44 and 45. The outer edge of that slot is flush with the inner surface of the cylindrical wall of the chamber 25. It will be observed that the slot extends around approximately one-fourth of the circumference of the cylindrical chamber and that it is so located as to be upstream from the choke valve and not blocked by the choke valve in any position thereof. It will also be noted that the aperture 35 is spaced radially outwardly of the coiled bimetal strip.

When the temperature in the chamber 25 is low, the tab 42 on the bimetal strip engages against the abutment 44 on the shorter land 47 and tends to hold the choke valve in its closed position. The bimetal strip then cooperates with the biasing means of the manifold pressure responsive or speed responsive choke actuating mechanism, increasing the closing force upon the choke with decreasing ambient temperatures. The thermostatic device thus improves the cold weather starting characteristics of an engine on which it is installed. It might be mentioned, in this connection, that the automatic choke control mechanism of the Reichenbach et al patent was particularly intended for lawn mower engines, which are not ordinarily started in very cold weather; but an engine having that type of choke control, modified with the thermostatic control device of this invention, is capable of easy starting even under conditions of extreme cold.

When the bimetal strip is subjected to high temperatures, its tab 42 engages the abutment 45 on the longer land 48, and the bimetal element then tends to resist closing of the choke valve. However, the thermostat does not completely prevent closure of the choke valve, and it should not do so inasmuch as starting of a single-cylinder engine requires some mixture enrichment even when the engine is hot. The bimetal element therefore applies such force to the choke valve as will allow it to be closed under its normal bias to the extent necessary to afford easy starting. It does this because its outer tab 42 has a substantial range of travel between the abutments 44 and 45, and therefore the bimetal cannot exert as much force at temperature extremes as it would if the tab 42 were anchored in a fixed position.

This permitted range of travel of the outer tab 42 has a further and incidental advantage. As pointed out in the above mentioned Thompson et al patent, a coiled bimetal choke actuator which is directly exposed to temperatures at the engine body and which has one of its ends connected with the choke valve and its other end restrained against all motion, cannot be expected to provide reliable choke control at both low ambient temperatures and high engine temperatures because it tends to be overstressed and permanently deformed at the high temperatures. In the present case the permitted travel of the tab 42 between the abutments 44 and 45 as the bimetal coils and uncoils in response to temperature changes reduces the stress to which it is subjected at the highest temperatures and thus tends to prevent permanent deformation. Also contributing to the prevention of such deforming stresses is the fact that temperatures in the thermostat chamber 25, although accurately representative of those in the engine body, will never be as high as the maximums attained by the engine body, due to heat losses along the flexible duct 38 that communicates the chamber 25 with the breather.

In the end portion of the choke shaft section 24 that projects into the chamber 25, there are a number of radial slots 50, in each of which the inwardly projecting tab 41 on the bimetal strip is receivable with a close fit. These slots are spaced from one another at rather small and uniform circumferential intervals around the choke shaft, and they open axially to the adjacent end of the shaft as well as radially to its periphery. Hence, with the choke valve assembled into the carburetor body and established in a predetermined position (e.g., fully closed), the coiled bimetal element can be inserted axially into the chamber 25 with its outer tab 42 in a predetermined relationship to the abutments 44 and 45, and the inner tab 41 can be inserted into whichever one of the slots 50 is most nearly in line with it. It will be apparent that if such installation of the thermostatic element is accomplished while it is maintained at a predetermined temperature, no further adjustment of the temperature responsive control device will be needed. Thus no special effort need be made establish the tabs 41 and 42 on the bimetal strip in a particular relationship to one another, and consequently the theromstatic element can be manufactured very inexpensively.

The bimetal element is held against axial displacement relative to the choke shaft and the chamber 25 by means of a rivet-shaped securement member 52 that has its stem portion 53 press-fitted into a coaxial well in the choke shaft and has its head portion 54 overlying the end of the choke shaft and at least as large in diameter as the shaft.

Figure 2:
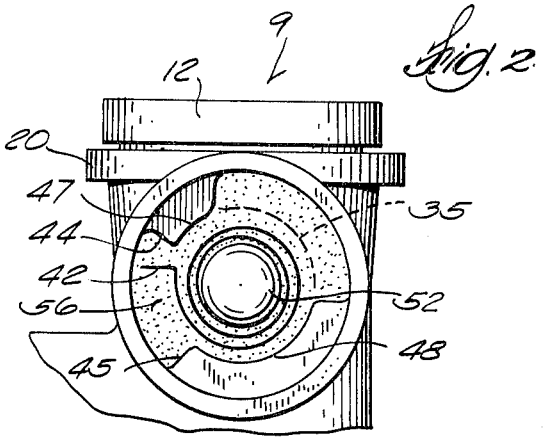
FIG. 2 is a view in side elevation of the upper portion of the carburetor body shown in FIG. 1, looking into the chamber that houses the thermostatic choke control device.
Figure 4:
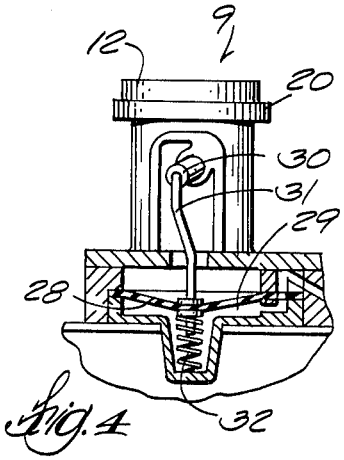
FIG. 4 is a fragmentary view, partly in elevation and partly in section, taken from the side of the carburetor body opposite the thermostatic device and showing the manifold pressure responsive choke actuating mechanism.
Figure 3:
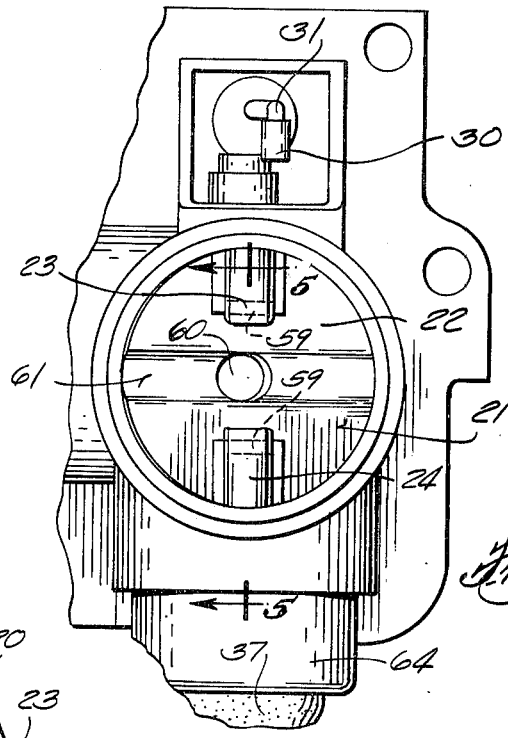
FIG. 3 is a top view of the portion of the carburetor that comprises the choke, its manifold pressure responsive actuating means and the chamber that houses the thermostatic device.

The cold air entering the mixing passage from the air cleaner tends to be at a higher pressure than the crankcase vapors that are intended to influence the condition of the bimetal strip. So far as possible, therefore, such air should be restrained against entering the chamber 25, and any such cold air as enters it should be diverted from the thermostatic element. To some extent such diversion is effected by locating the aperture 35 as far as possible from the coiled bimetal, and this explains why that opening is in the form of an arcuate slot located as described above. As a further expedient for deflecting such cold air away from the bimetal strip, there can be a suitable baffle within the chamber 25 itself. In the present case the baffle takes the form of a flapper valve member 56 comprising a flat piece of resiliently supple material such as neoprene. The flapper valve member flatwise overlies the wall 34 that separates the chamber 25 from the mixing passage and projects across substantially the entire aperture 35. It tends to restrict flow of air into the chamber 25 through the aperture 35 and it causes such air as enters the chamber to be diverted away from the bimetal strip and to flow along the cylindrical wall of the chamber. As those familiar with internal combustion engine breather systems will understand, the net flow through the chamber 25 is in the direction from the engine crankcase to the air mixing passage in the tubular portion 10 of the carburetor body. Flow in that direction is accommodated by reason of the fact that the flapper valve 56 can flex outwardly of the chamber and partway into the aperture 35, as will be apparent from FIG. 2. Such outward flexing of the flapper valve permits hot gases from the crankcase breather to flow through the chamber 25, but since the outlet resulting from such outward flexing is more restricted than the inlet provided by inward flexing of the flapper valve, there are hot gases in the chamber 25 at all times that the pressure in that chamber is at or above atmospheric pressure, and outside air can enter the chamber only when the pressure therein is sub-atmospheric. A hole 57 in the flapper valve member, through which the choke shaft extends, has a fairly snug fit on the choke shaft, and the flapper valve member is thus confined against axial motion and held in slightly spaced relation to the coiled bimetal by its engagement with the shaft. Bays or cutouts 58 in the flapper valve member accommodate the lands 47 and 48, which thus confine it against rotation with the shaft. Inasmuch as the flapper valve member overlies substantially the entire wall portion 34 in the thermostat chamber, it serves to a certain extent as an insulation that prevents heat losses through that wall.

The choke valve shaft sections 23 and 24 which are preferably plastic moldings, have bifurcated inner ends to snugly embrace diametrically opposite edge portions of the choke disc 22. Parallel ridges projecting from the surfaces of the disc engage the edges of the bifurcations in the shaft sections to hold the disc against edgewise lateral displacement with respect to the shaft sections, and endwise separation of the shaft sections from the disc is prevented by detents consisting of ridges 59 on the opposite sides of the disc and transverse grooves in the sides of the slots defined by the bifurcations of the shaft sections. The manner of assembling the choke valve with its shaft is thus similar to that of the Lechtenberg U.S. Pat. No. 3,118,433.

Also, as in the aforesaid Lechtenberg patent, a hole 60 in the center of the choke valve disc, flanked by oppositely facing semicylindrical grooves 61, accommodates the screw (not shown) that holds the air cleaner 19 assembled with the carburetor and enables the disc to be rotated through 90°.

As shown, the flexible duct 37 that extends from the crankcase breather is connected with the thermostat chamber 25 by means of a bell-shaped fitting 64 that has its wider end press-fitted into the outer end portion of the chamber. The lands 47 and 48 define the maximum depth to which the fitting can be inserted into the chamber. The duct is formed with a grommet-like terminal portion 66 that is sealingly engaged in a coaxial hole in the narrower end of the bell-shaped fitting 64.

From the foregoing description taken with the accompanying drawings it will be apparent that this invention provides a simple, inexpensive compact and reliable thermostatic control device for automatic choke control apparatus, particularly suitable for small single-cylinder engines and adapted for incorporation into both manifold pressure responsive mechanisms and engine speed responsive mechanisms.

Those skilled in the art will appreciate that the invention can be embodied in forms other than as herein disclosed for purposes of illustration.

The invention is defined by the following claims:

We claim:

1. An internal combustion engine that has a crankcase, a carburetor comprising a body in which there is a mixing passage and a choke that has a rotatable shaft which projects through a wall of the mixing passage, a crankcase breather that permits gases to flow substantially freely out of the crankcase but restricts entry of air thereinto, and duct means communicating the crankcase breather with said mixing passage, said engine being characterized by:

A. a portion of said duct means comprising a chamber which is adjacent to the mixing passage and into which said shaft projects; and B. a spirally coiled bimetal element in said chamber
   1. having its inner end portion connected with said shaft,
   2. having its outer end portion adapted to react against a portion of the wall of the chamber so that the bimetal element tends to position the choke valve in accordance with the temperature that prevails in said chamber, and
   3. which is so arranged in said chamber that gases pass thereacross in flowing from the crankcase to the mixing passage, so that the temperature in said chamber always closely reflects the operating temperature of the engine.

2. The internal combustion engine of claim 1 wherein the choke valve is connected with actuating means which tends to open it at high engine speeds and to close it when the engine is stopped, and wherein said portion of the duct means that comprises said chamber further comprises a part of the carburetor body, said engine being further characterized by:

C. said outer end portion of the bimetal element projecting radially outwardly from the convolutions thereof; and D. means on the wall of said chamber defining circumferentially spaced abutments that face in opposite circumferential directions, one of said abutments being engageable by the outer end portion of the bimetal element when the engine is cold, so that the bimetal element then tends to prevent opening of the choke valve, and the other of said abutments being engageable by the outer end portion of the bimetal element when the engine is hot so that the bimetal element then tends to prevent closing of the choke valve.

3. The engine of claim 2, wherein the inner end portion of the bimetal element projects radially inwardly from the coils thereof, further characterized by:

C. the shaft having a plurality of circumferentially spaced, radially outwardly opening slots therein, in each of which the inner end portion of the bimetal element is receivable, so that with a predetermined temperature of the bimetal and with the choke valve established in a predetermined position of its rotation, the outer end portion of the bimetal can be established in a predetermined relation to said abutments by inserting the inner end portion of the bimetal into a selected one of said slots.

4. In a carburetor for an internal combustion engine that has a crankcase breather through which gases are expelled substantially freely from the engine crankcase and which restricts entry of air thereinto, said carburetor having a body in which there is a mixing passage, a choke valve in said mixing passage rotatable with a shaft that has end portions projecting through opposite wall portions of the mixing passage, and choke valve actuating means connected with one end portion of said shaft and which so responds to a function of engine speed as to tend to open the choke valve at high engine speeds and to close it when the engine is stopped, means for preventing excessive opening of the choke valve when the engine is cold and for preventing complete closure of the choke valve when the engine is hot, the last mentioned means comprising:

A. means on the carburetor body defining a chamber
   1. which is adjacent to said mixing passage and communicated therewith and
   2. into which the other end portion of said shaft projects;

B. means on the carburetor body for communicating said chamber with the crankcase breather, so that gases expelled from the crankcase flow through said chamber to the mixing passage to maintain a temperature in said chamber that corresponds to the temperature of the engine; and C. a spirally coiled bimetal element in said chamber
   1. having an inner end portion connected with said other end portion of said shaft, and
   2. having an outer end portion reacting against the carburetor body, so that the bimetal element tends to hold the choke valve open when high temperatures prevail in said chamber and to hold it closed when low temperatures prevail in said chamber.

5. The carburetor of claim 4, further characterized by:

D. the outer end portion of the bimetal element projecting radially outwardly from the convolutions thereof; and E. said means on the carburetor body that define said chamber further defining a pair of opposing spaced apart abutments in said chamber, one of said abutments being engageable by the outer end portion of the bimetal element when the engine is hot, the other of said abutments being engageable by said outer end portion when the engine is cold.

6. The carburetor of claim 4, wherein said carburetor body has a substantially cylindrical wall portion that defines said chamber and has another wall portion common to said mixing passage and to said chamber and through which there is an arcuate slot which is closely adjacent to said cylindrical wall portion and which communicates said chamber with said mixing passage, further characterized by:

D. a flat, supply flapper valve member in said chamber, overlying said other wall portion of the carburetor body and confined between it and the bimetal element, said flapper valve member extending substantially across said slot to inhibit flow of air therethrough from the mixing passage and to divert around the bimetal element such air as enters the chamber from the mixing passage.

7. The carburetor of claim 1 wherein said means for communicating the interior of said chamber with a source of fluid having a temperature corresponding to that of the engine comprises means for connecting to the chamber one end of a duct that has its other end connectable with a crankcase breather on an engine with which the carburetor cooperates, said carburetor being further characterized by:

G. said chamber being further so communicated with the mixing passage that vapors vented from the crankcase breather are constrained to flow across the bimetal strip and into the mixing passage.

8. An internal combustion engine carburetor of the type having a body in which there is a mixing passage and having a choke valve in said mixing passage that is movable between open and closed positions, and wherein movement of the choke valve is effected by automatic choke control means comprising a thermostatic element with which the choke valve is connected and which tends to establish the position of the choke valve in accordance with temperature at the thermostatic element, said carburetor being characterized by:

A. the thermostatic element comprising a spirally coiled bimetal strip having a radially outwardly projecting outer end portion and a radially inwardly projecting inner end portion;

B. the carburetor body having means thereon defining a chamber adjacent to said mixing passage, in which chamber the thermostatic element in housed;

C. the choke valve having a shaft to which it is fixed and by which it is carried for rotational movement and one end portion of which projects into said chamber;

D. said end portion of the shaft having a plurality of radially outwardly opening slots at circumferentially spaced intervals therearound, in each of which the inner end portion of the bimetal strip is receivable, the several slots providing for adjustment of the position in which the thermostatic element tends to hold the choke valve when the thermostatic element is at a predetermined temperature;

E. the carburetor body having further means thereon defining opposite circumferentially facing abutments in said chamber, against each of which the outer end portion of the bimetal strip is engageable and which cooperate to limit rotation of the outermost convolution of the strip; and F. the carburetor body also having means thereon for communicating the interior of said chamber with a source of fluid that has a temperature which corresponds to the prevailing operating temperature of the engine.

9. The internal combustion engine of claim 1, wherein said portion of the duct means that comprises said chamber further comprises a part of the carburetor body, wherein said chamber has a substantially cylindrical side wall that surrounds the coiled bimetal element, and wherein said wall of the mixing passage through which said shaft projects also serves as an end wall of said chamber, further characterized by:

C. said wall of the mixing passage having an arcuate slot therethrough by which said chamber is communicated with the mixing passage, said slot, along its length, being closely adjacent to said cylindrical side wall so that cool air entering said chamber from the mixing passage tends to flow through the chamber along the cylindrical wall thereof and radially outwardly of the bimetal element.

10. The internal combustion engine of claim 9, further characterized by:

D. a flat, supple flapper valve member in said chamber, overlying its said end wall, said flapper valve member extending substantially across said slot to inhibit flow of air therethrough from the mixing passage into said chamber and serving to divert around the bimetal element such air as enters the chamber from the mixing passage.

* * * * *